United States Patent [19]

Wren, Jr. et al.

[11] 4,168,584

[45] Sep. 25, 1979

[54] KARATE FOOT PROTECTOR

[75] Inventors: Fred H. Wren, Jr.; Frank H. Babcock, III, both of St. Louis, Mo.

[73] Assignee: Pro-Tect, Inc., St. Louis, Mo.

[21] Appl. No.: 925,808

[22] Filed: Jul. 18, 1978

[51] Int. Cl.[2] ..... A41D 17/00

[52] U.S. Cl. ..... 36/2 R; 36/114

[58] Field of Search ..... 36/2 R, 1, 102, 105, 36/114, 50; 2/22

[56] References Cited

U.S. PATENT DOCUMENTS

| | | | |
|---|---|---|---|
| 2,491,297 | 12/1949 | Brown | 36/105 |
| 3,949,493 | 4/1976 | Rhee | 36/2 R |
| 4,103,437 | 8/1978 | Dillard | 36/2 R |

*Primary Examiner*—Patrick D. Lawson

*Attorney, Agent, or Firm*—Cohn, Powell & Hind

[57] ABSTRACT

This foot protector includes a front portion providing a protective cover for the toes and instep of the wearer and a wrap-around rear portion protecting the back and ankle portions of the foot, the protector being fully open at the bottom. The rear portion of the protector includes oppositely disposed sides and is formed into separable portions which are provided with lace openings so that they can be laced together by a single lace. The lace includes a side lace portion which draws the sides together, and a transverse portion which extends under the foot and cooperates with the side lacing to secure the protector to the foot. Reinforcing strips are provided to strengthen the lace margins and the junction between the front and rear portions of the shoe.

8 Claims, 7 Drawing Figures

KARATE FOOT PROTECTOR

BACKGROUND OF THE INVENTION

This invention relates generally to a foot protector for karate combat, and other martial art sports and particularly to a protector having lace ties.

The art of karate combat requires frequent use of the feed and hands and in order to avoid damage to these members protective clothing in the form of padded shoes and gloves are frequently used. It is necessary that such protective shoes be constructed so that they can be readily put on and taken off without damage to the shoe and without sacrificing the comfort of the wearer. This has caused considerable problems in the past.

Protective shoes are known, for example, the shoes disclosed in U.S. Pat. No. 3,769,722 which provide a protective cover that must be stretched in order to position it on the foot for the reason that the upper opening into which the foot in inserted must be small enough to enclose the ankle and hold the shoe comfortably in place. Another known shoe provides multiple nylon pile fasteners which permit enlargement of the foot receiving opening but require careful emplacement for satisfactory usage.

The above disadvantages have been overcome with the present foot protector in a manner not disclosed in the known cited art.

SUMMARY OF THE INVENTION

This foot protector for karate combat can be easily removed and replaced without damage to the protector and without sacrifice of comfort to the wearer.

The foot protector includes a unitary body formed from a resilient foam core material and having a flexible outer casing, the body providing a front portion adapted to cover the upper foot and a wrap-around rear portion adapted to cover the back and ankle portions of the foot. The rear portion consists of opposed side portions which are separated into parts attachable together by a continuous lace which includes a side lace portion between the separated parts and a transverse lace portion extending under the foot and cooperating with the side lace portion to secure the protector to the foot.

The front portion of the protector includes a double elastic loop passing under the forward portion of the foot.

The side portions of the protector include a plurality of lace receiving openings by which the lace connects the separated side portions together and passes between opposed sides under the foot.

The inner side portion is formed into fore and aft abutting parts having vertical lace receiving openings and held together by the continuous lace.

The outer side portion includes at least two lace openings receiving the transverse portion of the continuous lace extending under the foot.

The lace openings are reinforced by a nylon reinforcing strip molded into the foot protector, and the continuous lace is formed from an elastic material.

This foot protector is relatively simple and inexpensive to manufacture and can be effectively and comfortably used by practitioners of the karate martial arts.

DESCRIPTION OF THE PREFERRED EMBODIMENT

Figure 1:
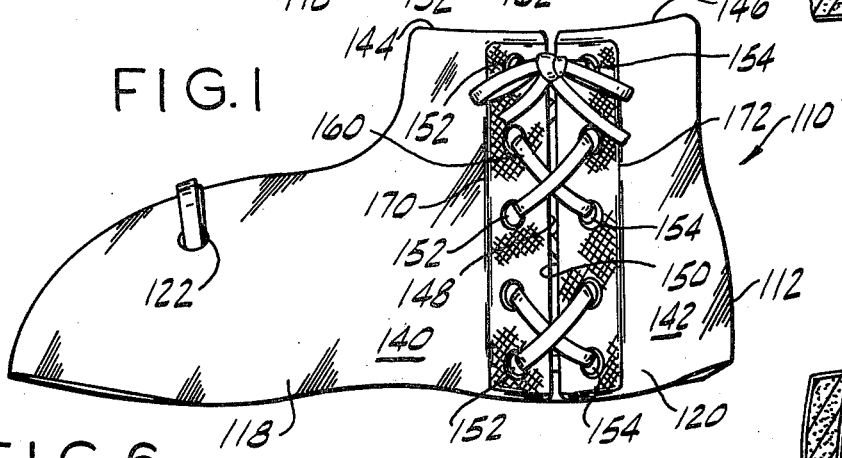
FIG. 1 is a side elevational view of the foot protector illustrating the side lacing arrangement.
Figure 3:
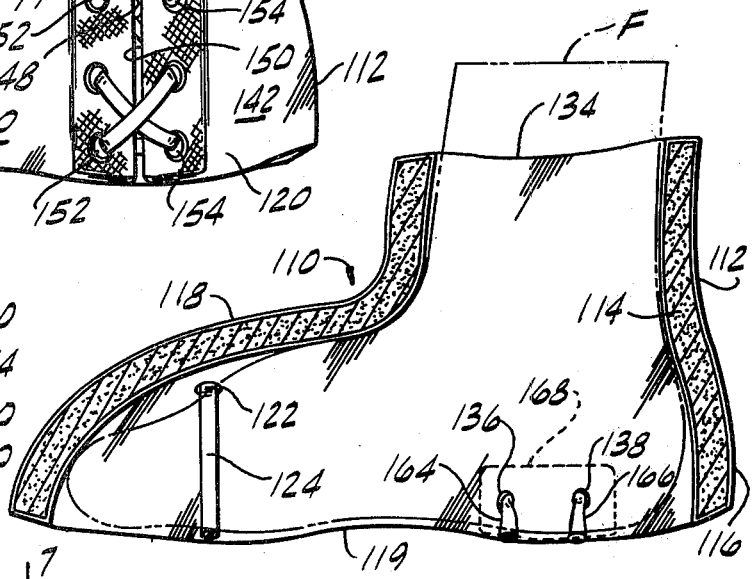
FIG. 3 is a longitudinal sectional view thereof.

Referring now by reference numerals to the drawings and first to FIGS. 1 and 3, it will be understood that the foot protector, generally indicated by numeral 110 comprises essentially of a unitary body 112 having an inner core 114 of resilient material such as rubber foam or the like, and a flexible outer casing 116 formed by dipping the core into liquid polyvinyl chloride or the like. The protector 110 shown in the drawing is for the right foot. The body 112 which is open at the bottom, includes a front portion 118 covering the instep or upper portion of the foot F, the toes and the front sides of said foot. The body 112 also includes a wrap-around rear portion 120 which is integrally formed with the front portion 118 and is adapted to cover the back and ankle portions of the foot F. The bottom of the body 112, defined by a circumferential lower margin 119, is open.

Figure 4:
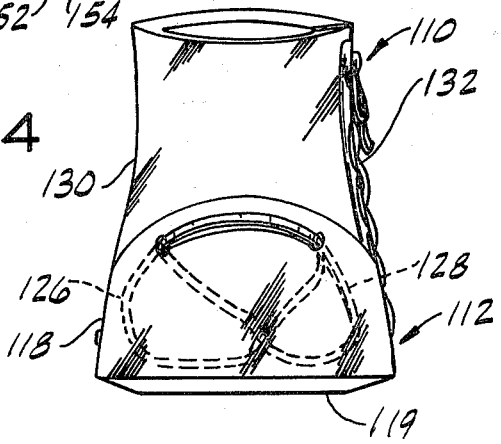
FIG. 4 is a front end elevational view thereof.

The body front portion 118 is provided with opposed front spaced openings 122 which receive a substantially continuous, double looped elastic band 124 which, in the preferred embodiment as shown in FIGS. 3 and 4, supports the forward portion of the foot F as by one loop 126 passing around the great toe and another loop 128 passing around one or more of the remaining toes.

The body rear portion 120 includes outer and inner side portions 130 and 132 constituting first and second portions respectively. Both side portions 130 and 132 extend rearwardly from the front portion 118, with which they are unitarily formed, to join at the extreme rear end of the body 112. The outer side portion 130, as shown in FIG. 3, extends generally above the front portion 118, is defined by an upper margin 134 and includes lower lace openings 136 and 138. The inner side portion 132, as shown in FIG. 1, is formed from two separable parts 140 and 142 which are defined by upper margins 144 and 146 respectively and by substantially vertical margins 148 and 150 respectively which, in the preferred embodiment, are substantially in abutting relation. As shown clearly in FIG. 1, the separable parts 140 and 142 each includes a plurality of lace openings 152 and 154 respectively and five in number in the preferred embodiment, disposed adjacent vertical margins 148 and 150 respectively.

Figure 2:
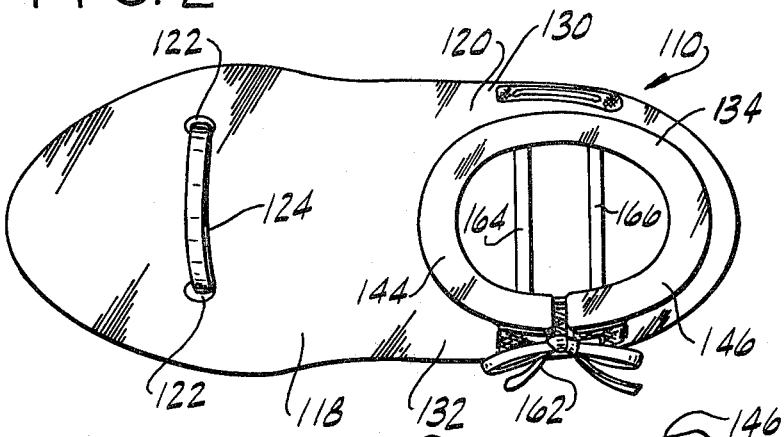
FIG. 2 is a plan view thereof.
Figure 5:
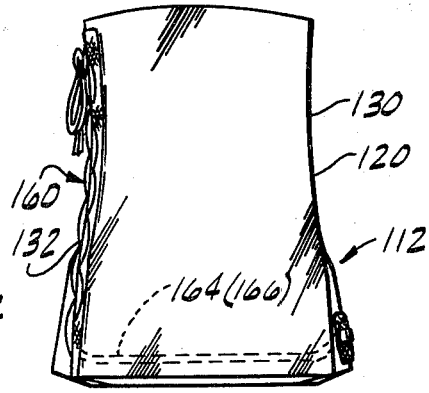
FIG. 5 is a rear end elevational view thereof.

As clearly shown in FIGS. 1 and 3, the foot protector 110 includes a continuous elastic lace 160 which is received in laced relation through all of the vertical lace openings 152 and 154, and the lower side lace openings 136 and 138, said openings constituting first and second lace retaining means respectively. When laced in the manner shown, vertical side lace portion of the lace 160 includes a first lace portion which acts as a drawstring to secure the protector 110 to the foot and can be tied at the top, as by a bow 162 in the conventional manner. In addition, as shown particularly in FIGS. 2, 4, and 5, the lace 160, by being received through openings 136 and 138, provides a transverse, second lace portion consisting of elements 164 and 166 which are disposed under the rear portion of the foot F. By this arrangement of parts, the transverse lace elements 164 and 166 provide rearward support for the underside of the foot F and combine with the front elastic band portions 126 and 128 to effectively secure the protector 110 to the foot. In the preferred embodiment, the lace 160 is elastic so that the lower double lace portions are suitably resilient.

In the preferred embodiment, a strip of nylon reinforcing material, generally indicated by numeral 168, is secured as by adhesion to the resilient foam core 114 prior to coating said core with the flexible outer casing 116 to reinforce the area around the lace openings 136 and 138. In like manner, the area containing the lace openings 152 and 154 adjacent margins 148 and 150 respectively, is reinforced by a nylon strip 170 and 172 respectively, disposed between the resilient foam core 114 and the flexible outer casing 116.

It will be understood that the provision of the separable parts 140 and 142 of the inner side portion 132 allows the vertical margins 148 and 150 to be spread at their upper end to permit the foot opening to be increased. Thus, when the lace 160 is untied the foot F can be readily inserted into the relatively large opening provided and when the lace is tied the "opening" is decreased by the drawstring action of the lace 160 which effectively provides an opening of a size defined by the combined upper margins 134, 144, and 146, which fits snugly aroung the ankle portion of the foot F.

Figure 7:
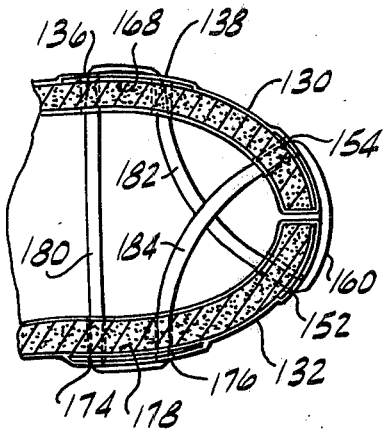
FIG. 7 is a fragmentary sectional view taken on line 7—7 of FIG. 6.
Figure 6:
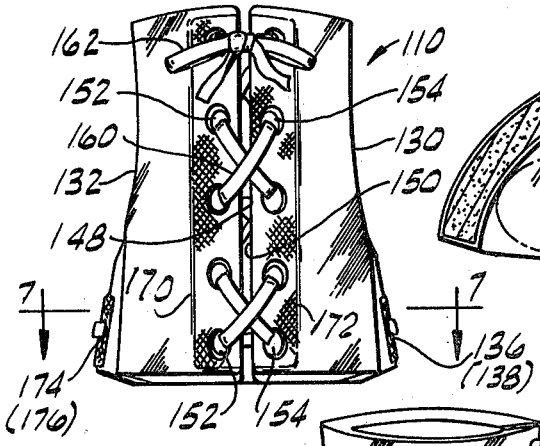
FIG. 6 is a rear end elevational view of a modified shoe.

It will be understood that although the lace in the embodiment shown is disposed intermediate the inner side portion of the foot protector, it could be moved to the rear, as shown in FIGS. 6 and 7, in which, for convenience, like parts are given the same reference numeral. The arrangement shown in FIGS. 6 and 7 provides lower lace openings 174 and 176, and a reinforcing strip 178 is provided in the foot protector inner side portion 132 corresponding to the lace openings 138 and 188 and the reinforcing strip 168 respectively, provided in the outer side portion 130, each pair of lace openings providing second lace retaining means. As clearly shown in FIG. 7, the lace 160 includes a single element 180 extending between lace openings 136 and 174, and crossed elements 182 and 184 extending between lower lace openings 152 and 138, and lower lace openings 154 and 176, said single and crossed elements cooperating to constitute a second lace portion. By this arrangement of parts, the lace elements 180, 182 and 184 provide transverse lace portions holding the protector to the underside of the foot F and combine with the front elastic band portions 126 and 128 to effectively secure the protector 110 to the foot. The bow 162 of the lace 160 may be tied at the rear, as shown in FIG. 6 or, by wrapping around the upper side portions, may be tied at the front or side as desired.

We claim as our invention:

1. A foot protector for karate combat comprising:

(a) a unitary body formed from a resilient foam core having a flexible outer casing, the body including:

(1) a front portion adapted to cover the upper portion of the foot and the front sides thereof, (2) a rear portion adapted to cover the ankle portion of the foot, (3) an open bottom portion defined by a lower margin, (4) said rear portion being formed into two at least partially separable parts providing adjacent substantially vertical margins disposed in side-by-side relation and having a plurality of first lace retaining means disposed adjacent thereto, and (5) one of said front and rear portions including second lace retaining means disposed in spaced relation from said first lace retaining means, and (b) a lace including a first portion received by said first lace retaining means to connect the separable parts together and including a second portion received between said first and second lace retaining means to pass under the foot and cooperate with said first portion to secure the protector to the foot.

2. A foot protector as defined in claim 1, in which:

(c) said lace retaining means are provided by lace openings.

3. A foot protector as defined in claim 1, in which:

(c) said lace is elastic.

4. A foot protector as defined in claim 1, in which:

(c) said rear portion includes first and second opposed side portions extending rearwardly from said front portion, said first side portion being formed into said separable parts including said first lace retaining means, and (d) said second side portion including said second lace retaining means disposed oppositely of said first lace retaining means.

5. A foot protector as defined in claim 4, in which:

(e) said first lace retaining means are provided by lace openings including a lower lace opening disposed in each of said separable parts of said first side portion, (f) said second lace retaining means are provided by a pair of lace openings disposed in said second side portion, and (g) said second lace portion extends between said openings of said first and second side portions.

6. A foot protector as defined in claim 1, in which:

(c) said front portion includes a pair of transversely spaced openings, and (d) double elastic loop means is disposed between said transversely spaced openings to attach the shoe to the front portion of the foot.

7. A foot protector as defined in claim 1, in which:

(c) said rear portion includes first and second opposed side portions extending rearwardly from said front portion a substantially equal amount to provide said separable parts including said first lace retaining means, and (d) each of said side portions include second lace retaining means disposed in spaced relation from said first lace retaining means.

8. A foot protector as defined in claim 1, in which:

(c) reinforcing strips are molded between said foam core and said flexible casing about each lace retaining means.

* * * * *